United States Patent [19]

Kanter

[11] Patent Number: 4,874,344

[45] Date of Patent: Oct. 17, 1989

[54] SOFT ANIMAL TOYS

[76] Inventor: John E. Kanter, 135 4th Street, Parkmore, Sandton, Transvaal, South Africa

[21] Appl. No.: 213,233

[22] Filed: Jun. 29, 1988

[30] Foreign Application Priority Data

Jul. 2, 1987 [ZA] South Africa ..... 87/4806

[51] Int. Cl.[4] ..... A63H 3/00; A63H 3/02; G09B 23/28

[52] U.S. Cl. ..... 446/268; 446/369; 434/273

[58] Field of Search ..... 446/268, 369, 370; 434/273

[56] References Cited

U.S. PATENT DOCUMENTS

| | | | |
|---|---|---|---|
| 1,218,398 | 3/1917 | Gurtov | 446/369 |
| 1,543,351 | 6/1925 | Webb | 446/369 |
| 2,288,798 | 7/1942 | Fleming | 446/369 |
| 2,347,405 | 4/1944 | Ford | 446/369 |
| 4,197,670 | 4/1980 | Cox | 434/273 |
| 4,237,649 | 12/1980 | Goldfarb | 446/330 |
| 4,288,222 | 9/1981 | Kling | 446/369 |
| 4,423,834 | 1/1984 | Rush | 446/268 |
| 4,739,529 | 4/1988 | Mills | 446/369 |

FOREIGN PATENT DOCUMENTS

| | | | |
|---|---|---|---|
| 1020462 | 2/1953 | France | 446/369 |
| 2448368 | 9/1980 | France | 434/273 |
| 2060412 | 5/1981 | United Kingdom | 446/268 |
| 2177611 | 1/1987 | United Kingdom . | |

*Primary Examiner*—Robert A. Hafer
*Assistant Examiner*—Michael Brown
*Attorney, Agent, or Firm*—Birch, Stewart, Kolasch, & Birch

[57] ABSTRACT

A soft animal toy includes a parent animal toy and one or more baby animal toys which can be accommodated inside an abdominal cavity of the parent. The cavity is served by a closable opening. The toy also includes a container for the parent toy which is representative of a sleeping bag or bed and which has shoulder straps enabling it to be carried back-pack style by a child.

3 Claims, 2 Drawing Sheets

FIG. 3
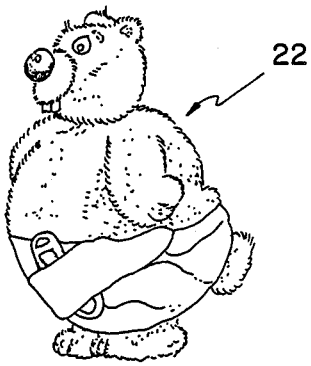
FIG. 5
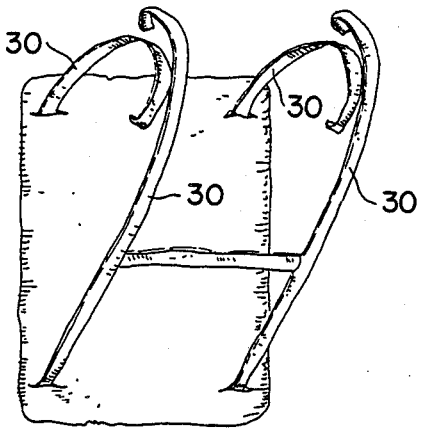
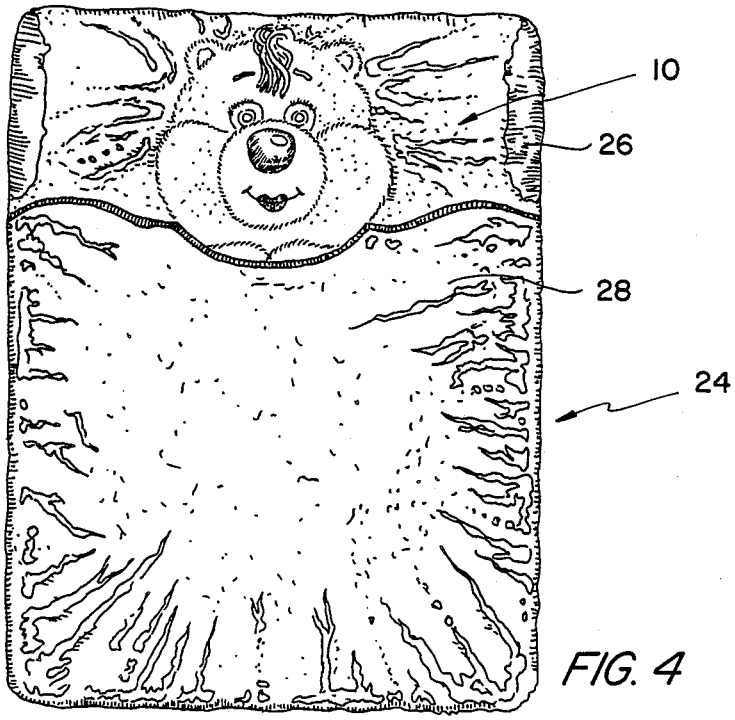
FIG. 4

SOFT ANIMAL TOYS

BACKGROUND TO THE INVENTION

This invention relates to soft animal toys.

Soft animal toys have been marketed widely for many years and are still extremely popular with young children. Examples of such toys are teddy bears, dogs and so forth.

It is the object of the invention to provide a soft animal toy which has novelty value and which also serves an educational function.

SUMMARY OF THE INVENTION

According to the invention, there is provided a soft animal toy which comprises a parent animal toy having an abdominal cavity, a closable opening leading to the abdominal cavity from the outside and, located within the abdominal cavity, at least one baby animal toy which can be withdrawn from the abdominal cavity through the opening.

In a preferred version of the invention, the abdomen of the parent animal toy is distended when it accommodates the at least one baby animal toy, thereby to give the impression that the parent toy is pregnant.

Further according to the invention, the toy includes a container for the parent animal toy, such container representing a bed or sleeping bag for the parent animal toy. Preferably, the container is fitted with shoulder straps by means of which it can be carried on the back of a child.

BRIEF DESCRIPTION OF THE DRAWINGS

One embodiment of the invention will now be described by way of example only with reference to the accompanying drawings in which:

FIG. 3 shows a baby teddy bear;

FIG. 4 shows a container for the teddy bear of FIG. 1; and

FIG. 5 shows a rear view of the container seen in FIG. 4.

DESCRIPTION OF A PREFERRED EMBODIMENT

Figure 1:
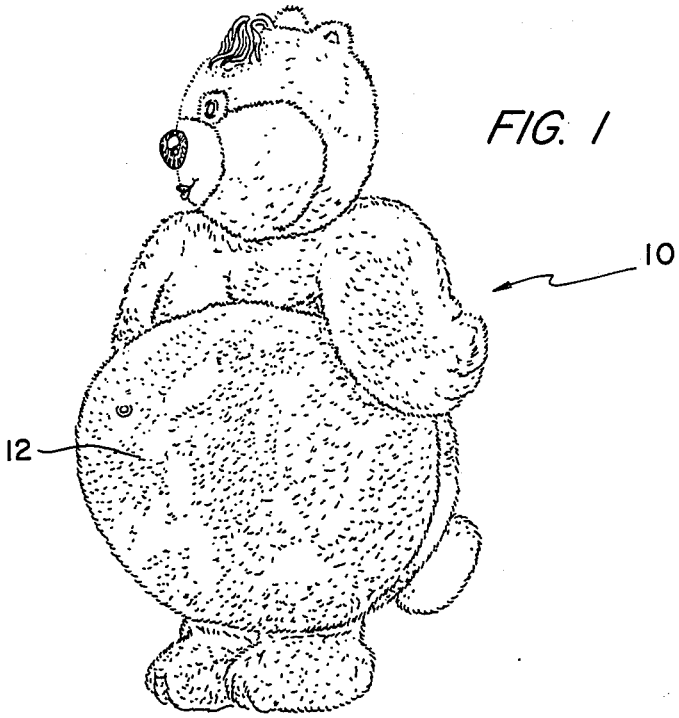
FIG. 1 shows a perspective view of a parent teddy bear.

FIG. 1 shows a parent teddy bear 10 which is of soft, furry construction with an appearance intended to appeal to small children. The teddy bear 10 has an enlarged abdomen 12 which gives it the appearance of being pregnant.

Figure 2:
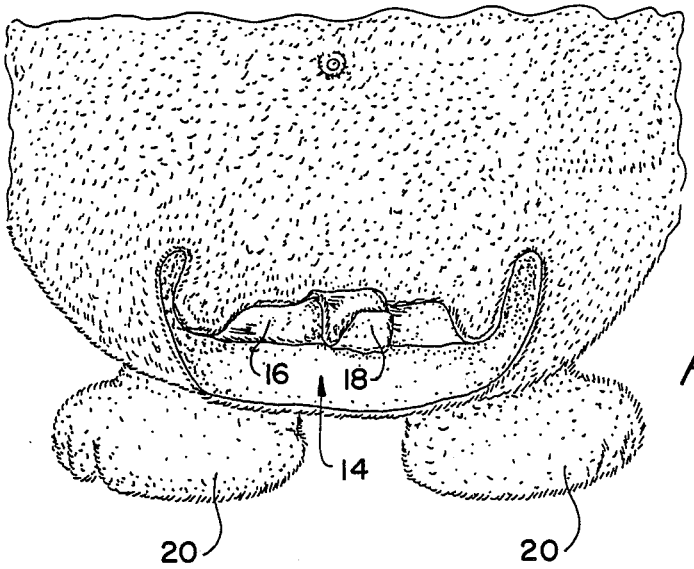
FIG. 2 shows a view of the lower abdomen of the teddy bear of FIG. 1.

As shown by FIG. 2, the lower part of the abdomen of the teddy bear 10 has an opening 14 which can be closed by means of a flexible flap 16. The flap 16 has a tongue 18 carrying a Velcro fastener by means of which the flap can be held in position once it has been pulled closed over the opening 14 and between the legs 20 of the teddy bear 10. The opening 14 leads to an abdominal cavity of the parent teddy bear 10. The toy of the invention also includes one or more baby teddy bears 22 which are considerably smaller in size than the parent teddy bear 10. When one or more baby teddy bears 22 are located inside the abdominal cavity of the teddy bear 10, the abdomen thereof has the distended appearance of FIG. 1. When the baby teddy bears are withdrawn from the abdominal cavity through the opening 14, the abdomen of the teddy bear 10 reverts to a flatter non-pregnant shape.

FIG. 4 shows a flexible container 24 for the teddy bear 10. The container 24, which is representative of a sleeping bag or bed, includes a rear sheet 26 and a smaller front sheet 28 which is sewn to the rear sheet along three of its edges. When the teddy bear 10 is placed inside the container, its head pokes out beyond the sheet 28 as illustrated.

Sewn to the rear sheet 26 of the container 24 are shoulder straps 30 carrying Velcro fasteners 32 at their free ends. When the straps are connected, they can be placed over a child's shoulders, thereby enabling the child to carry the container and its contents in the manner of a knapsack.

A non-illustrated feature of the toy is the provision of miniature clothes such as dresses for the teddy bear 10. As shown by FIG. 3, the baby teddy bear 22 has a fitted nappy.

Not only does the illustrated toy have novelty value which it is believed will be appealing to small children, but it also serves an educational function in that it will assist small children to understand the prenatal stage in the life of an infant.

Note the invention is not only applicable to toys representative of bears but also of other non-human, fantasy animal types.

I claim:

1. A toy which of of soft construction and which comprises:

a parent fantasy animal toy;

a cavity in the abdomen of the parent fantasy animal toy;

a closable opening situated between the legs of the parent fantasy animal toy and leading into the cavity;

an infant fantasy animal toy located inside the cavity and distending the abdomen of the parent fantasy animal toy to give the parent fantasy animal toy the external appearance of being pregnant;

said infant fantasy animal toy having the appearance of an infant of the parent and being removable from the cavity through the opening with the result that the parent fantasy animal toy reverts to an appearance of non-pregnancy;

a container for the parent fantasy animal toy having the appearance of a bed or sleeping bag and in which the parent fantasy animal toy is locatable with its head protruding visibly from the container; and straps attached to the container for enabling the container to be worn in the manner of a back-pack by a child.

2. The toy according to claim 1, wherein the parent fantasy animal toy is a larger teddy bear and the infant fantasy animal toy is an infant teddy bear.

3. The toy according to claim 2, and further including a diaper positioned on the infant fantasy animal toy.

* * * * *